US008859941B2

(12) United States Patent
Gladhill et al.

(10) Patent No.: US 8,859,941 B2
(45) Date of Patent: Oct. 14, 2014

(54) SURFACE TEMPERATURE COOKING CONTROL

(75) Inventors: Matthew David Gladhill, Louisville, KY (US); Paul Newsom, Louisville, KY (US); Heather Ann Thomas, Louisville, KY (US)

(73) Assignee: General Electric Company, Schenectady, NY (US)

( * ) Notice: Subject to any disclaimer, the term of this patent is extended or adjusted under 35 U.S.C. 154(b) by 280 days.

(21) Appl. No.: 12/914,149

(22) Filed: Oct. 28, 2010

(65) Prior Publication Data

US 2012/0103966 A1 May 3, 2012

(51) Int. Cl.
*H05B 1/02* (2006.01)
*F24C 7/08* (2006.01)

(52) U.S. Cl.
CPC ..... *F24C 7/085* (2013.01)
USPC ..... 219/391; 219/412; 219/414; 219/494; 219/497

(58) Field of Classification Search
CPC ..... H05B 1/02; H05B 1/0258; H05B 1/0263; H05B 1/0266; H05B 3/026; H05B 3/0076; F24C 7/085; F24C 7/043; F24C 7/046; F24C 7/081; F24C 7/087
USPC ..... 219/391, 494, 412–414, 483–486, 481, 219/506, 497
See application file for complete search history.

(56) References Cited

U.S. PATENT DOCUMENTS

| | | | | | |
|---|---|---|---|---|---|
| 1,336,105 | A | * | 4/1920 | Sutton | 219/395 |
| 3,059,088 | A | * | 10/1962 | Eff | 219/513 |
| 3,073,938 | A | * | 1/1963 | Turner et al. | 219/398 |
| 3,094,605 | A | * | 6/1963 | Welch | 219/398 |
| 3,293,411 | A | * | 12/1966 | Dills | 219/393 |
| 4,004,948 | A | | 1/1977 | Smith | |
| 4,317,985 | A | * | 3/1982 | Wilson | 219/210 |
| 4,357,522 | A | * | 11/1982 | Husslein et al. | 219/400 |
| 4,541,733 | A | | 9/1985 | Andre | |
| 4,585,925 | A | | 4/1986 | Andre | |
| 4,852,544 | A | | 8/1989 | Williams et al. | |
| 5,402,709 | A | * | 4/1995 | Carron et al. | 99/331 |
| 5,573,335 | A | | 11/1996 | Schinazi | |
| 6,072,165 | A | | 6/2000 | Feldman | |
| 6,135,013 | A | | 10/2000 | Barrena | |
| 6,663,009 | B1 | | 12/2003 | Bedetti et al. | |
| 7,420,140 | B2 | | 9/2008 | Lenhart, Jr. et al. | |
| 2004/0089648 | A1 | * | 5/2004 | Griffey et al. | 219/400 |
| 2006/0016801 | A1 | * | 1/2006 | Kitabayashi et al. | 219/497 |
| 2007/0084849 | A1 | * | 4/2007 | Smith et al. | 219/413 |
| 2011/0114634 | A1 | * | 5/2011 | Nevarez | 219/725 |

* cited by examiner

*Primary Examiner* — Mark Paschall
(74) *Attorney, Agent, or Firm* — Global Patent Operation; Douglas D. Zhang

(57) ABSTRACT

An oven includes an oven liner defined by front, top, bottom, back and side panels, a heating element thermally coupled to the oven liner, a temperature sensor configured to detect a temperature of a panel of the oven cavity, and a controller operatively coupled to the temperature sensor and the heating element. The controller is configured to energize the heating element as a function of the detected temperature.

17 Claims, 3 Drawing Sheets

SURFACE TEMPERATURE COOKING CONTROL

BACKGROUND OF THE INVENTION

The present disclosure generally relates to appliances, and more particularly to a temperature control system for an oven.

Current technologies for controlling the temperature of an oven typically rely upon feedback from a temperature sensor in the controlled space of the oven cavity. The temperature, reported by the sensor, is the temperature of the sensor itself, which is primarily influenced by one or more heating elements, the thermal energy of the oven surfaces, objects within the oven cavity, and the air temperature within the oven cavity. It is also influenced by air flow through the oven cavity, the opening and closing of the oven door, the position of the temperature sensor, the mass of the sensor, the position of oven vents and potentially other effects.

Temperature sensors, such as resistive temperature devices ("RTD") are mounted within the oven cavity and are used to measure the temperature value within the oven cavity. In some cases, the sensors can be coupled to the walls of the oven for structural support, while the purpose is sensing the temperature value within the oven cavity. This information from the temperature sensor is used to estimate the temperature of the oven system for control of the oven. However, using one or more sensors to measure the temperature value from within the oven cavity can lead to a lack of oven performance accuracy. The environment inside the cavity is subject to a variety of events that affect the thermal state of the system, including different size loads, open doors or vents, different control setpoints, large temperature changes, and more. Those sources of variation in the oven environment can affect oven performance to the degree that the temperature measurement method is sensitive to such changes. More accurate measurement of the oven temperature improves the ability to raise and adjust the thermal energy level with consistency and predictability, enhancing cooking performance.

Typically, a resistive temperature device that hangs slightly below the inside top surface of the oven cavity is used to measure the temperature value in the oven cavity. Generally, oven controls using feedback from a single temperature sensor must use that single input to determine the state of the oven, particularly including the oven temperature. This can require that certain assumptions be made about the oven and the cooking conditions. These assumptions are not always correct or accurate due to the transitory nature of the oven and the variety of food loads. The temperature data from the air space inside the oven cavity does not always provide the best feedback for optimum cooking performance. It would be advantageous to control the cooking cycle of the oven by monitoring surface temperatures outside the oven cavity that affect cooking performance. It would also be advantageous to be able to take into consideration multiple sensor data in monitoring and measuring the temperature value of the oven cavity.

Accordingly, it would be desirable to provide a system that addresses at least some of the problems identified above.

BRIEF DESCRIPTION OF THE INVENTION

As described herein, the exemplary embodiments overcome one or more of the above or other disadvantages known in the art.

One aspect of the exemplary embodiments relates to an oven. In one embodiment, the oven includes an oven liner defined by front, top, bottom, back and side panels, a heating element thermally coupled to the oven liner, a temperature sensor configured to detect a temperature of the oven liner and a controller operatively coupled to the temperature sensor and the heating element. The controller is configured to energize the heating element as a function of the detected temperature.

in another aspect, the disclosed embodiments are directed to a control system for an oven. In one embodiment, the control system includes an oven liner defined by one or more panels, a heating element thermally coupled to the oven liner, a temperature sensor coupled to a panel of the oven, the temperature sensor configured to detect a temperature of the panel of the oven, and a controller operatively coupled to the temperature sensor and configured to receive signals from the temperature sensor and energize the heating element by allowing energy to be supplied as a function of the detected panel temperature.

A further aspect of the disclosed embodiments relates to a method for controlling performance of an oven cavity. In one embodiment, the method includes positioning a heating element in thermal engagement with the oven, providing a temperature sensor configured to detect a temperature of a wall of the oven, and operatively coupling a controller to the temperature sensor and the heating element, the controller being configured to energize the healing element as a function of the temperature of the wall of the oven.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
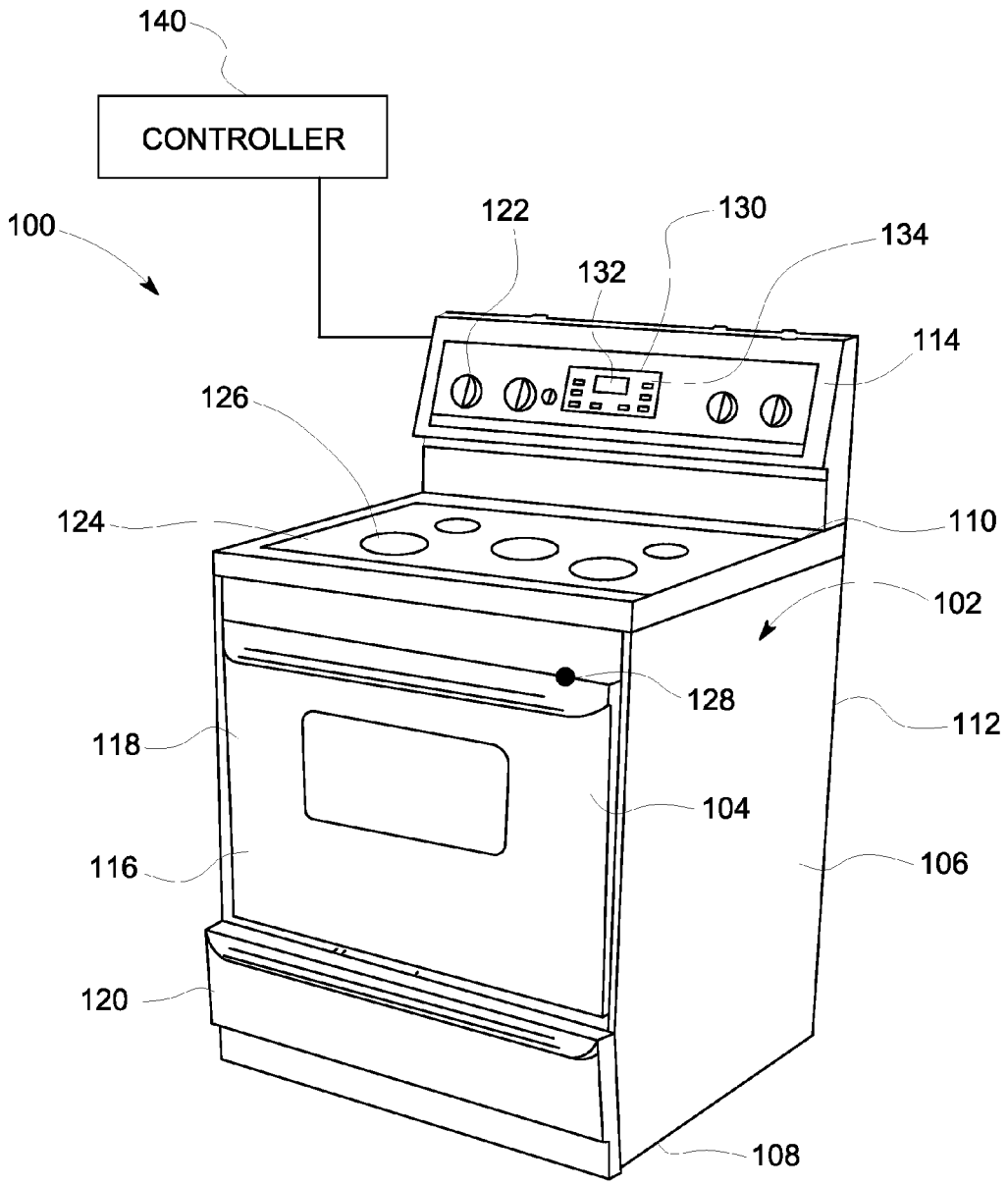
FIG. 1 is a perspective view of an exemplary range incorporating aspects of the disclosed embodiments.

Referring to FIG. 1, an exemplary appliance such as a freestanding range in accordance with the aspects of the disclosed embodiments is generally designated by reference numeral 100. The aspects of the disclosed embodiments are generally directed to controlling a temperature of an oven to consistently and predictably raise the thermal energy level of an object in the oven by sensing a temperature of the walls of the oven liner rather than merely the temperature value within the oven cavity.

As is shown in FIG. 1, the cooking appliance 100 is generally in the form of a freestanding range, an oven that includes a cooktop or an oven that does not include a cooktop 124, such as for example a wall oven. For the purposes of the description herein, the range 100 is shown with a cooktop 124. The range 100 includes a cabinet or housing 102 that has a front portion 104, opposing side panels 106, a base portion 108, a top portion 110, and a back panel 112.

In the exemplary embodiment illustrated in FIG. 1, the top portion 110 of the range 100 includes the cooktop 124. The cooktop 124 includes one or more surface heating units or burner elements, generally referred to as surface heating units 126. Although five surface heating units or burner elements are shown in this example, in alternate embodiments, the range 100 could include more or fewer than five surface heating units 126.

The range 100 also includes an oven unit 116. Although the aspects of the disclosed embodiments are described herein with respect to the single oven configuration shown in FIG. 1, in alternate embodiments, the range 100 could comprise a multiple oven unit. For example, the range can include a free standing gas or electric range, a wall oven, a gas oven, a speed cooking oven or a dual fuel oven. The range 100 includes an oven door 118 and a pullout drawer 120, the operation of which is generally understood. A door latch handle 128 is used for locking door 118 in a closed position during a self-cleaning operation.

In one embodiment, the cabinet 102 of the range 100 includes a control surface 114 that supports one or more controls, generally referred to herein as burner control 122. The burner control or control knob 122 shown in FIG. 1 is generally in the form of a knob style control that extends outwardly from and can be supported by the control surface 114, which in one embodiment comprises a backsplash. Although the aspects of the disclosed embodiments will generally be described herein with respect to control knobs, in alternate embodiments, any suitable controls or switches, such as for example, pushbutton or electronic switches, can be used to regulate a state or mode of each of the surface-heating units 126. In one embodiment, a control panel 130 includes a plurality of input selectors or switches 134 and a display 132 cooperating with control knob 122 to form a user interface for selecting and displaying cooking cycles, warming cycles and/or other operating features. In one embodiment, the input selectors or controls 134 can be in the form of push buttons or electronic switches.

In one embodiment, the oven 100 includes a controller 140. The controller 140 is coupled to, or integrated within, the control panel 130 and configured to receive inputs and commands from for example, the controls 122 and 134, and control the various operations and functions of the oven 100. In one embodiment, the controller 140 can include or comprise an electronic range control.

Figure 2:
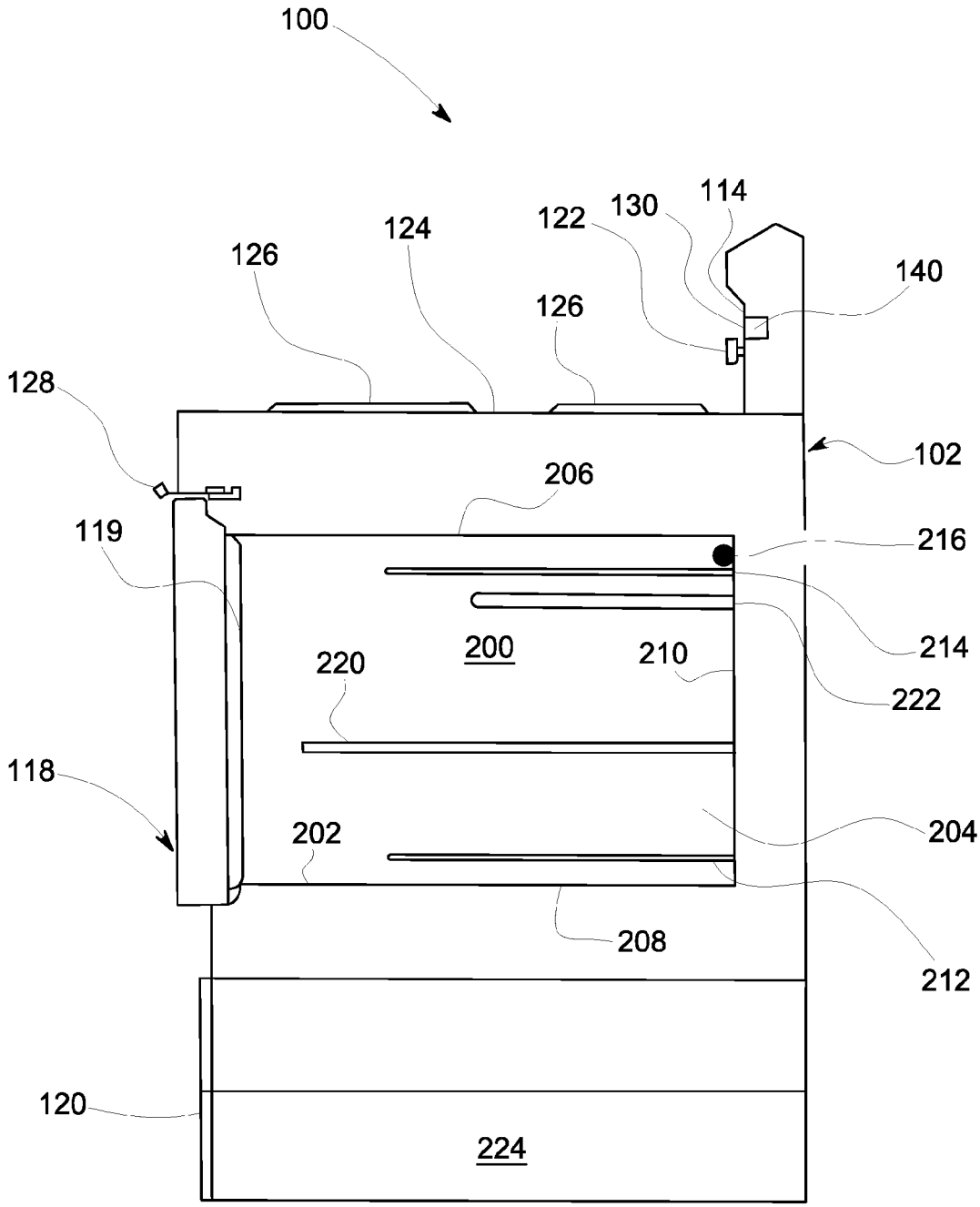
FIG. 2 is a cross-sectional view of the range illustrated in FIG. 1.

FIG. 2 is a cross-sectional side view of the oven 100 shown in FIG. 1. Positioned within the cabinet 102 is a cooking chamber, also referred to herein as an oven cavity 200. The oven cavity 200 is formed or defined by a box-like wall or oven liner 202. The panels or walls of the oven liner 202, which include a front panel 119, vertical side panels 204, a top panel 206, a bottom panel 208 and a rear or back panel 210, generally define, or define the boundaries of the oven cavity 200. As is shown in FIG. 2, the front panel 119 is attached to or part of the door 118. In the embodiment shown in FIG. 2, the door 118 is a front opening door. In alternate embodiments, any suitable door can be used. Although in this example the door 118 is shown on the front of the oven 100, in alternate embodiments, the door 118 can be in any suitable location, such as for example, the top of the oven 100.

In one embodiment, the rear or back panel 210 of the oven cavity 200 can also include a fan and convection fan cover (not shown) that are suitably attached to, or part of the back panel 210, and for purposes of the description herein, are considered part of the back panel 210. Similarly, the side 204 and top 206 panels can include plates for lighting or other elements, and such plates are considered to be part of such panels for purposes of the description herein.

The oven cavity 200 is provided with at least one heating element, such as a lower heating element 212 or upper heating element 214. In one embodiment, the lower heating element 212 is positioned adjacent to the bottom panel 208 and the upper heating element 214 is positioned adjacent to the top panel 206. In one embodiment, the lower and upper heating elements 212, 214 are referred to as bake and broil heating elements. In alternate embodiments, the heating elements can be arranged in any suitable manner.

Although the heating elements 212, 214 are generally described herein as lower and upper heating elements, the heating elements can include multiple parts, located in various portions of the oven cavity 200, where each part is separately powered and controlled. The use of such heating elements allows for more precise control of the heating elements and directivity of the heating power. In an exemplary embodiment, at least one cooking rack 220 for supporting an object is positioned within the oven cavity 200.

For the purposes of the description herein, the heating elements 212, 214 are illustrated as being disposed within the oven cavity 200. In an alternate embodiment, one or more of the heating elements 212, 214 can be disposed on an exterior of the oven cavity 200. In this embodiment, the heating element is in thermal engagement with, or thermally coupled to the oven cavity 200 and is designed to transmit thermal energy into the oven cavity 200 from the exterior of the cavity. Examples of this type of heating element arrangement can be seen in warming drawers, hidden bake ovens and glass cooktop ranges with the infrared emitter located underneath the glass.

In an embodiment where the range 100 is a gas range, the lower heating element 212 can comprise a gas burner and upper heating element 214 can comprise a gas broil burner. The broil burner 214 can be in addition to, or instead of, lower gas burner 212, though the lower gas burner 212 is typically present. In a further alternative embodiment, the oven unit 116 can include an electrical heating element 222 in place of or in addition to one of the heating elements 212, 214. Where the range 100 is an electric range, the lower and upper heating elements 212, 214 comprise electric or resistive type heating elements.

In one embodiment, the range 100 also includes a second oven or warming platform 224 coupled to and positioned beneath the oven cavity 200. The warming platform 224 is accessed via the door 120.

The operation of oven unit 116 and the warming platform 224 are generally controlled by the controller 140, operatively coupled to the user interface input located on control panel 130 for user manipulation to select cooking cycles, warming cycles and/or other operating features. In response to user manipulation of the user interface input or switches 134, the controller 140 operates the various components of oven unit 116 and warming platform 224 to execute selected cooking cycles, warming cycles and/or operating features.

Referring to FIG. 2, one or more temperature sensor(s) or probe(s) 216, such as a contact temperature sensor, are positioned within the oven cavity 200 to sense and/or monitor a temperature of the oven liner 202. In one embodiment, the temperature sensor 216 is mounted to one or more of the panels 119, 204, 206, 208, or 210 for sensing the temperature of the oven liner 202. It is a feature of the aspects of the disclosed embodiments to measure the temperature of one or more of the front, back, lop and bottom and side wall panels of the oven liner 202 rather than the temperature value of a sensor in the space of the oven cavity for regulating the thermal energy level of the object in the oven cavity 200.

The aspects of the disclosed embodiments are directed to directly measuring the temperature of the surface that is emitting the radiation inside the oven cavity 200 as opposed to merely the temperature value within the oven cavity 200. The temperature value within the oven cavity 200, which as previously noted can be affected by a number of different factors, does not always provide the best or accurate feedback for optimum cooking performance. The one or more temperature sensors 216 allow the oven controller 140 to detect the temperature characteristics of the oven liner 202, and use the measured temperature characteristics of the oven liner 202 to regulate the operation of the oven unit 116, and in particular the amount of energy being put to the objects or food loads within the oven, and otherwise to maximize the performance of the oven unit 116.

Monitoring the temperature of the oven liner 202 can also allow higher wattage heating elements and higher temperatures to be used for different cycles or operations of the oven unit 116. For example, enamel crazing is a concern in high temperature ovens, and particularly, in self-cleaning ovens. By being able to sense the temperature of the oven liner 202, the oven temperatures can be more accurately controlled and regulated with respect to the enamel crazing limits. Being able to bring the oven temperature closer to the enamel-crazing limit can improve self-cleaning performance.

In one embodiment, measuring the temperature of the oven liner 202 can be used to detect an object within the oven cavity 200, which can be particularly useful in a pre-heat operation, for example. An object within the oven cavity 200 can cause heat to be blocked or absorbed, instead of transmitted through the empty space of the cavity. For example, when an object within the oven cavity 200 absorbs heat, the heat emitted from one surface of the oven liner 202 is not detected as an increase in temperature on the opposite surface of the oven liner 202. The detection of such a discrepancy in the temperatures of the oven liner 202 can be used to identify the potential presence of a foreign object in the oven cavity 200. Similarly, if a pan or other object is positioned on the cooking rack 220, while either or both of the lower and upper heating elements 212, 214 are powered, one or more of the top panel 206 and the bottom panel 208 may be heated to a greater or lesser extent than the other. During a cooking phase, a cooking object is expected to be within the oven cavity 200, and the deviations could be monitored and/or controlled to remain within predetermined limits. During a pre-heat phase, where an object may not be expected to be within the oven cavity 200, the identification of a deviation from the generally understood limits, or discrepancies between the surface temperatures of the different panels 204-208 of the oven liner 202 can be used to identify the potential for a foreign object in the oven cavity 200.

As another example, the aspects of the disclosed embodiments can be used to detect the presence of a covering over the bottom panel 208 of the oven liner 202. Coverings are sometimes used with the intent to aid oven cleaning by preventing spills from contacting the bottom panel 208. However, coverings over the oven bottom panel 208 can have unintended consequences that are undesirable. Oven coverings can be made of different materials, but one covering that can damage an oven is a sheet of aluminum foil, particularly when used in an oven with a lower heating element 212 that is outside the oven cavity 202. The energy from the lower heating element 212 is designed to pass through the bottom panel 208 and enter into the oven cavity 200. However, a sheet of aluminum foil that covers the bottom panel 208 can reflect the energy back to the bottom panel 208 and not allow that energy to dissipate to the whole oven liner 202. Because all the energy is focused on the oven floor and not distributed throughout the oven liner 202, the temperature sensor 216 continues to report a low temperature and the control continues to send energy to the lower heating element 212. This process can continue to the point where the bottom panel 208 gets so much energy that the temperature raises to the point where it melts the aluminum and the aluminum becomes fused to the bottom panel 208. This causes permanent damage to the bottom panel 208. The use of a temperature sensor 216 on the surface of bottom panel 208 can provide an input to the control, such as the controller 140, that can be programmed in such a manner to use that input to prevent damage from occurring.

Figure 3:
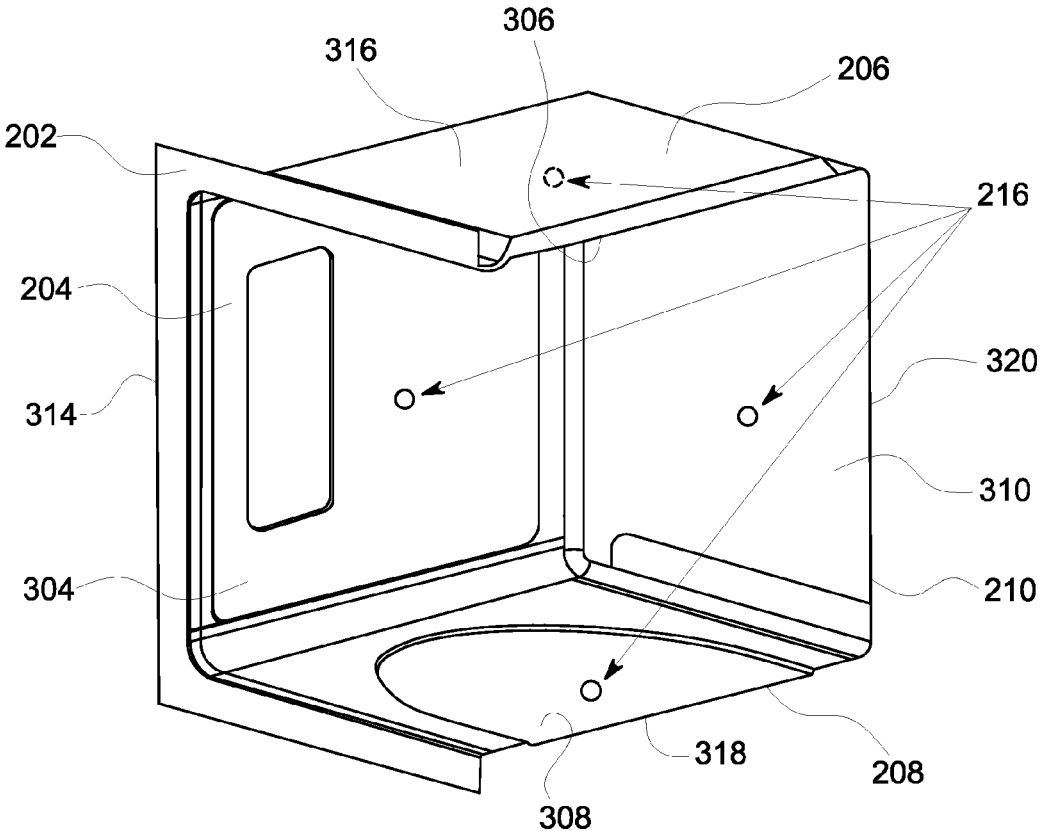
FIG. 3 is a partial cross-sectional view of the oven cavity of the range illustrated in FIG. 2.

FIG. 3 illustrates a partial cross-sectional illustration of the oven cavity 200 shown in FIG. 2. In this example, only portions of the liner 202 of the oven cavity 200 are shown. As shown in FIG. 3, one or more temperature sensors 216 are mounted to the inside surfaces 304, 306, 308 and 320 of each of the side panel 204, top panel 206, bottom panel 208, and rear panel 210 respectively. For purposes of this example, the front panel 119 is not shown. Although only one temperature sensor 216 is shown mounted to each of the panels 204, 206, 208 and 210, in alternate embodiments, any suitable number of temperature sensors can be mounted or coupled to each panel 204, 206, 208 and 210. It is a feature of the disclosed embodiments to provide sensor feedback on the surface temperatures of the oven liner 202 to control the oven operation. In an embodiment where multiple sensor data is used, the multiple sensor data can provide for better control of the cooking and oven performance through precise control options resulting from an awareness of the surface temperatures of the oven liner 202. The data can be used to more precisely control the heating elements and cooking process. For example, if the temperature data shows that one wall or surface of the oven liner 202 is warmer or cooler than another surface(s), the heating element(s) 212, 214 can be selectively controlled to provide or direct more or less heat towards one or more areas of the oven liner 202. Illustratively, if the data shows that the top panel 206 is warmer than the bottom panel 208, in a oven unit 116 with multiple heating elements 212, 214, or directional heating elements (not shown), one or more of the heating elements 212, 214 can be selectively controlled to provide more heat to the bottom panel 208, and/or less heat to the top panel 206, until the surface temperatures equalize or reach pre-determined or optimum operational values. The use of multiple sensors 216 on a single panel will provide additional data as to the temperature of the panel. For example, if the data shows that a forward portion (closest to the door 118) of a side panel 204 varies in temperature from a rearward portion (towards the back of the oven liner 202), this could be indicative that the forward portion of the oven liner 202 is at a different temperature than the rearward portion. In one embodiment, one or more of the heating units 212, 214 could be correspondingly adjusted to equalize the temperatures. The adjustment could be automatic, under the control of the controller 140, or a manual operation by the user. For example, in one embodiment, the user can be prompted via the control panel 130 and display 132 to manually make the temperature or heater adjustment.

Although the temperature sensor 216 is shown in FIGS. 2 and 3 as being coupled or mounted on an inside surface 304, 306, 308, 310 of the panels 204-210 of oven liner 202, in alternate embodiments, the temperature sensor 216 can be coupled to an exterior surface of one or more of the panels of the oven liner 202, such as for example, one or more of surfaces 314, 316, 318 and 320. The aspects of the disclosed embodiments can control the operation of the oven unit 116 by taking measurements of surface temperatures outside the oven liner 202 that can affect cooking performance. By correlating the surface temperatures to actual cooking conditions, more precise and controlled cooking conditions can be achieved.

Figure 4:
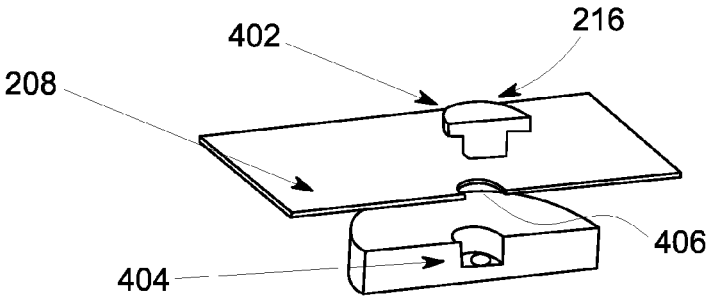
FIG. 4 is a perspective view of an exemplary sensor that can be used in conjunction with the aspects of the disclosed embodiments.

The temperature sensor 216 can comprise any suitable sensor for measuring a surface temperature of an oven liner 202. In one embodiment, the temperature sensor 216 can be permanently mounted or bonded to a surface of the oven liner 202. Examples of non-removable sensors can include typical resistive temperature devices, thin film resistive temperature devices and thermocouples. Alternatively, the temperature sensor 216 can be removably coupled to the surface of the oven liner 202. Removable sensors can generally be attached via a coupling to the oven liner 202. FIG. 4 illustrates one example of a sensor 216 that is removable. In this example, the sensor 216 comprises a sensor portion 402 that is coupled through the panel 208 to a receiver portion 404. The choice of panel 208 in this example is merely for descriptive purposes. The panel 208 includes an opening 406 to enable the sensor portion 402 and receiver portion 404 to be suitably coupled together. The use or a removable device for the sensor 216 can enable ease of installation, removal and replacement in the field, if needed.

The disclosed embodiments may also include software and computer programs incorporating the process steps and instructions described above. In one embodiment, the programs incorporating the process described herein can be stored on or in a computer program product and executed in one or more processors and/or computers. The controller 140 illustrated in FIG. 1 can include computer readable program code means stored on a computer readable storage medium, such as a memory for example, for carrying out and executing the process steps described herein. In one embodiment, the computer readable program code is stored in a memory of the controller 140. In alternate embodiments, the computer readable program code can be stored in memory or memory medium that is external to, or remote from, the controller 140. The memory can be direct coupled or wireless coupled to the controller 140.

The controller 140 may be linked to another computer system or controller (not shown), such that the controllers are capable of sending information to each other and receiving information from each other. In one embodiment, the controller 140 could include a server computer or controller adapted to communicate with a network, such as for example, a wireless network or the Internet.

The controller 140 is generally adapted to utilize program storage devices embodying machine-readable program source code, which is adapted to cause the controller 140 to perform the method steps and processes disclosed herein. The program storage devices incorporating aspects of the disclosed embodiments may be devised, made and used as a component of a machine utilizing optics, magnetic properties and/or electronics to perform the procedures and methods disclosed herein. In alternate embodiments, the program storage devices may include magnetic media, such as a diskette, disk, memory stick or computer hard drive, which is readable and executable by a computer. In other alternate embodiments, the program storage devices could include optical disks, read-only-memory ("ROM") floppy disks and semiconductor materials and chips.

The controller 140 may also include one or more processors for executing stored programs, and may include a data storage or memory device on its program storage device for the storage of information and data. The computer program or software incorporating the processes and method steps incorporating aspects of the disclosed embodiments may be stored in one or more computer systems or on an otherwise conventional program storage device.

The aspects of the disclosed embodiments measure the temperatures of the oven wall in an oven system and use the measured wall temperature to control the heating cycles of the oven. By measuring the temperature of the wall of the oven, the oven temperature can be controlled more accurately, enamel-crazing issues can be avoided, and higher wattage heating elements can be utilized. More accurate measurement of the oven temperatures can allow the oven temperature to be brought closer to the enamel crazing limits, which can improve self-cleaning performance. The elimination of a resistive temperature device hanging in the oven cavity should also improve the usable volume of the oven cavity and improve the appearance. Measurement of the oven wall temperature can also be used to detect objects within the oven cavity by measuring and comparing differentials between temperature measurements on the different walls of the oven cavity. Thus, the sensing or measurement of the wall of the oven cavity rather than the merely the temperature within the oven cavity can provide advantages not previously realized.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An oven comprising:

an oven liner defined by panels;

a heating element thermally coupled to the oven liner;

a temperature sensor thermally coupled to a panel of the panels and configured to detect a temperature of the panel;

a different temperature sensor thermally coupled to another panel of the panels; and a controller operatively coupled to the temperature sensor, the different temperature sensor and the heating element, the controller being configured to energize the heating element as a function of the detected temperature of the panel and detect a presence of an object within the oven by detecting a deviation in temperature between the panel and the another panel.

2. The oven of claim 1, wherein the oven liner defines an oven cavity within the oven.

3. The oven of claim 1, wherein the panel has an inner surface and an outer surface, the temperature sensor being coupled to one or both of the inner surface and the outer surface.

4. The oven of claim 1, wherein the temperature sensor is a contact temperature sensor.

5. The oven of claim 1, wherein the temperature sensor is bonded to the panel.

6. The oven of claim 1, wherein the temperature sensor is removably coupled to the panel.

7. The oven of claim 1, wherein the temperature sensor comprises a receiver portion coupled to an outer surface of the panel and a sensor portion coupled to an inner surface of the panel.

8. The oven of claim 1, wherein each of the panels comprises an inner facing surface and an outer facing surface, and a temperature sensor is coupled to each of the inner surface and the outer surface.

9. The oven of claim 1, wherein the controller is further configured to selectively control the heating element to provide more or less heat to one or more of the panels.

10. A control system for an oven, comprising:

an oven liner defined by panels;

a heating element thermally coupled to the oven liner;

a temperature sensor thermally coupled to a panel of the panels, the temperature sensor being configured to detect a temperature of the panel;

a different temperature sensor thermally coupled to another panel of the panels; and a controller operatively coupled to the temperature sensor, the different temperature sensor and the heating element, and configured to receive signals from the temperature sensor and the different temperature sensor, and energize the heating element by allowing energy to be supplied as a function of the detected temperature of the and detect a presence of an object within the oven by detecting a deviation temperature between the panel and the another panel.

11. The control system of claim 10, wherein the controller is further configured to energize the heating element by allowing energy to be supplied as a function of the detected temperature of one or both of the panel and the another panel.

12. The control system of claim 10, wherein the controller is further configured to selectively control the heating element to provide more or less heat to one or more of the panels.

13. A method for controlling performance of an oven, comprising:

positioning a heating element in thermal engagement with the oven;

providing a temperature sensor that is thermally coupled to a wall of the oven;

providing a different temperature sensor that is thermally coupled to another wall of the oven; and operatively coupling a controller to the temperature sensor, the different temperature sensor and the heating element, the controller being configured to energize the heating element as a function of the temperature of the wall of the oven and detect a presence of an object within the oven by detecting a deviation in temperature between the wall and the another wall of the oven.

14. The method of claim 13, wherein the temperature sensor is removably coupled to the wall of the oven.

15. The method of claim 13, wherein the temperature sensor is coupled to an outer surface of the wall of the oven.

16. The method of claim 13, wherein the controller is further configured to energize the heating element in dependence of the temperature measured by one or both of the temperature sensor and the different temperature sensor.

17. The method of claim 13, wherein the controller is further configured to selectively control the heating element to provide more or less heat to one or both of the wall and the another wall.

* * * * *